US009556723B2

(12) United States Patent
Georgi et al.

(10) Patent No.: US 9,556,723 B2
(45) Date of Patent: Jan. 31, 2017

(54) GEOSTEERING BOREHOLES USING DISTRIBUTED ACOUSTIC SENSING

(71) Applicants: Daniel T. Georgi, Houston, TX (US); Sebastian Csutak, Houston, TX (US)

(72) Inventors: Daniel T. Georgi, Houston, TX (US); Sebastian Csutak, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 449 days.

(21) Appl. No.: 14/100,735

(22) Filed: Dec. 9, 2013

(65) Prior Publication Data

US 2015/0159478 A1 Jun. 11, 2015

(51) Int. Cl.
*E21B 47/022* (2012.01)
*E21B 7/04* (2006.01)

(52) U.S. Cl.
CPC ..... *E21B 47/02208* (2013.01); *E21B 7/046* (2013.01)

(58) Field of Classification Search
CPC .... E21B 47/02208; E21B 7/046; E21B 47/12; E21B 47/14; E21B 7/04; E21B 44/00; E21B 47/022; E21B 47/00; E21B 47/0002; G01S 11/14; G01S 11/16
See application file for complete search history.

(56) References Cited

U.S. PATENT DOCUMENTS 7,040,390 B2 5/2006 Tubel et al.
7,448,447 B2 11/2008 Walford
7,730,947 B2 6/2010 Stegemeier et al.
7,898,494 B2 3/2011 Brune et al.
7,909,094 B2 3/2011 Schultz et al.
8,070,840 B2 12/2011 Diaz et al.
8,233,782 B2 7/2012 Vinegar et al.
(Continued)

FOREIGN PATENT DOCUMENTS

EP 1815101 B1 11/2005
WO 2009009437 A2 1/2009
(Continued)

OTHER PUBLICATIONS

Schlumberger, Oilfield Review, Autumn 2002, URL: https://slb.com/~/media/Files/resources/oilfield_review/ors02/aut02/composite.pdf, pp. 48-50.

(Continued)

*Primary Examiner* — An T Nguyen
(74) *Attorney, Agent, or Firm* — Cantor Colburn LLP

(57) ABSTRACT

A method of estimating position of a borehole includes: disposing an acoustic sensor in a first borehole in an earth formation, the acoustic sensor including a plurality of measurement locations disposed along a length of the first borehole; drilling a portion of a second borehole in the earth formation using a drilling assembly; taking distributed acoustic measurement data over a time period during the drilling by the plurality of measurement locations, the acoustic measurement data based at least in part due to an acoustic signal generated by the drilling assembly and detected by the plurality of measurement locations; processing the measurement data to estimate a distance between the drilling assembly and the acoustic sensor; and controlling directional parameters of the drilling based on the distance.

18 Claims, 4 Drawing Sheets

(56) References Cited

U.S. PATENT DOCUMENTS

| | | | | |
|---|---|---|---|---|
| 8,245,780 | B2 | 8/2012 | Fidan et al. | |
| 8,427,162 | B2 | 4/2013 | Bespalov et al. | |
| 2005/0190649 | A1 | 9/2005 | Eisner et al. | |
| 2009/0067287 | A1* | 3/2009 | Berkovitch | G01V 1/303 367/40 |
| 2010/0044108 | A1 | 2/2010 | Bespalov et al. | |
| 2010/0284250 | A1* | 11/2010 | Cornish | E21B 47/02208 367/124 |
| 2010/0300696 | A1 | 12/2010 | McCalvin et al. | |
| 2010/0315900 | A1 | 12/2010 | Difoggio et al. | |
| 2011/0171049 | A1 | 7/2011 | Wonitoy | |
| 2012/0092960 | A1* | 4/2012 | Gaston | E21B 47/101 367/35 |
| 2013/0043029 | A1 | 2/2013 | Vinegar et al. | |
| 2013/0175030 | A1 | 7/2013 | Ige et al. | |

FOREIGN PATENT DOCUMENTS

| | | | |
|---|---|---|---|
| WO | 2012027105 | A1 | 3/2012 |
| WO | 2012067611 | A1 | 5/2012 |
| WO | 2013173704 | A1 | 11/2013 |

OTHER PUBLICATIONS

International Search Report and Written Opinion, International Application No. PCT/US2014/069078, Date of Mailing Mar. 23, 2015, Korean Intellectual Property Office; International Search Report 3 pages, Written Opinion 10 pages.

* cited by examiner

GEOSTEERING BOREHOLES USING DISTRIBUTED ACOUSTIC SENSING

BACKGROUND

Some multiple borehole systems, particularly those that include deviated or horizontal portions, typically require some form of monitoring to avoid intersecting the boreholes. For example, Steam Assisted Gravity Drainage (SAGD) systems include an injection borehole that provides a heat source (e.g., steam) for heating bitumen and/or heavy oil, and a recovery borehole to collect and produce the bitumen and/or heavy oil. The boreholes are typically maintained generally parallel at a selected distance from one another. Thus, monitoring or detection should be employed to allow for accurate directional drilling of the boreholes.

SUMMARY

A method of estimating position of a borehole includes: disposing an acoustic sensor in a first borehole in an earth formation, the acoustic sensor including a plurality of measurement locations disposed along a length of the first borehole; drilling a portion of a second borehole in the earth formation using a drilling assembly; taking distributed acoustic measurement data over a time period during the drilling by the plurality of measurement locations, the acoustic measurement data based at least in part due to an acoustic signal generated by the drilling assembly and detected by the plurality of measurement locations; processing the measurement data to estimate a distance between the drilling assembly and the acoustic sensor; and controlling directional parameters of the drilling based on the distance.

A system for estimating a position of a borehole includes: an acoustic sensor disposed in a first borehole in an earth formation, the acoustic sensor including a plurality of measurement locations disposed along a length of the first borehole; and a processor configured to perform: receiving acoustic measurement data from the plurality of measurement locations over a time period during drilling by a drilling assembly of a portion of a second borehole in the earth formation, the acoustic measurement data based at least in part on an acoustic signal generated by the drilling assembly and detected by the plurality of measurement locations; and processing the measurement data to estimate a distance between the drilling assembly and the acoustic sensor.

BRIEF DESCRIPTION OF THE DRAWINGS

The following descriptions should not be considered limiting in any way. With reference to the accompanying drawings, like elements are numbered alike.

DETAILED DESCRIPTION

Figure 1:
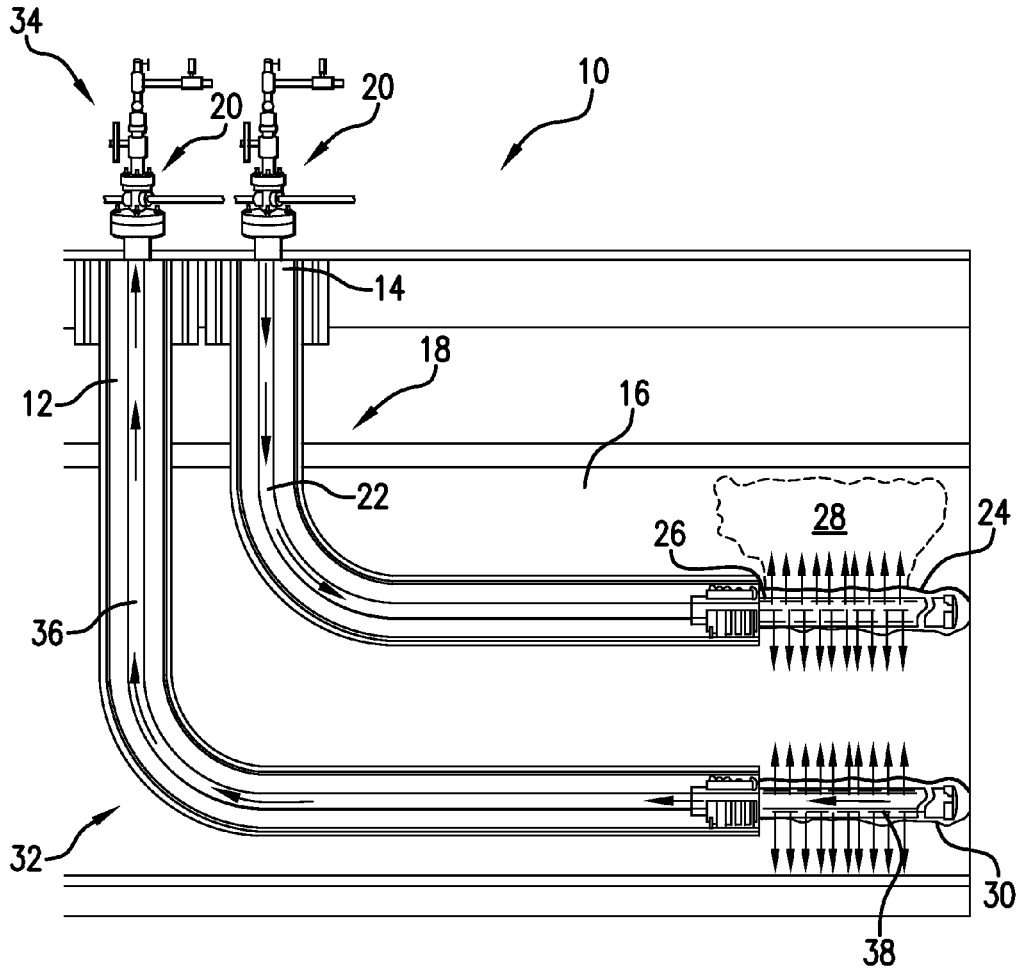
FIG. 1 depicts an exemplary embodiment of a formation production system.

Referring to FIG. 1, an exemplary embodiment of a multiple borehole downhole system 10 is shown. In this embodiment, the system 10 is a production system configured to perform steam assisted gravity drainage (SAGD) operations, but is not so limited. The system 10 can be configured to perform any energy industry operation that utilizes multiple boreholes, such as stimulation, drilling, geosteering, completion, measurement, monitoring and/or and formation evaluation operations. In addition to petroleum and energy industry applications, the system can be used in other applications for borehole steering and positioning, such as geothermal systems.

In this embodiment, the system 10 includes a first borehole 12 and a second borehole 14 extending into an earth formation 16. In one embodiment, the formation includes bitumen, heavy crude oil, and/or other unconventional hydrocarbon deposits such as oil sands and oil shale formations. As described herein, "borehole" or "wellbore" refers to a single hole that makes up all or part of a drilled borehole. As described herein, "formations" refer to the various features and materials that may be encountered in a subsurface environment. Accordingly, it should be considered that while the term "formation" generally refers to geologic formations of interest, that the term "formations," as used herein, may, in some instances, include any geologic points or volumes of interest (such as a survey area).

The second borehole 14 includes an injection assembly 18 having an injection valve assembly 20 for introducing steam from a thermal source (not shown), an injection conduit 22 and an injector 24. The injector 24 receives steam from the conduit 22 and emits the steam through a plurality of openings such as slots 26 into a surrounding region 28. Bitumen in region 28 is heated, decreases in viscosity, and flows substantially with gravity into a collector 30.

A production assembly 32 is disposed in the first borehole 12, and includes a production valve assembly 34 connected to a production conduit 36. After region 28 is heated, the bitumen flows into the collector 30 via a plurality of openings such as slots 38, and flows through the production conduit 36, into the production valve assembly 34 and to a suitable container or other location (not shown).

In this embodiment, at least a portion of boreholes 12 and 14 are parallel horizontal boreholes. In other embodiments, the boreholes 12, 14 may advance in a vertical direction, a horizontal direction and/or an azimuthal direction, and may be positioned relative to one another as desired.

Figure 2:
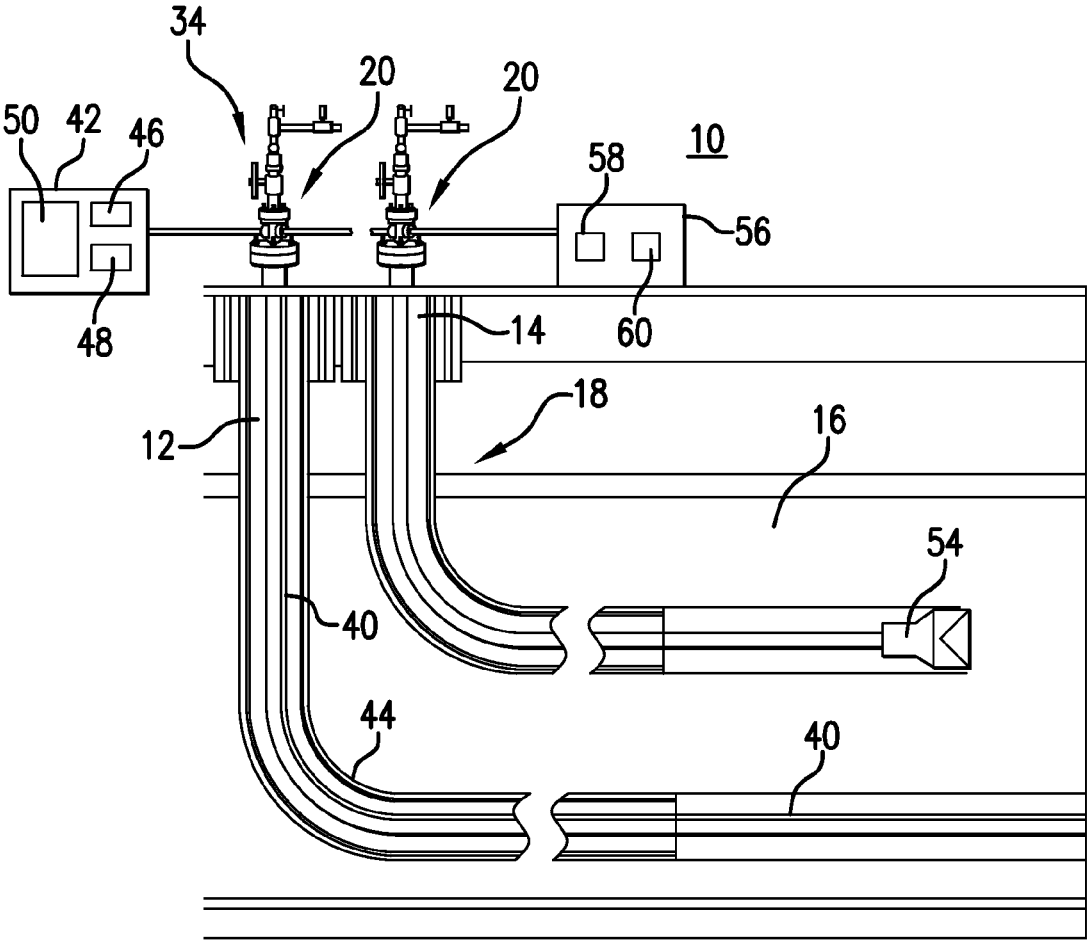
FIG. 2 depicts an exemplary embodiment of a measurement assembly for detecting a location of a borehole during drilling.

Referring to FIG. 2, an embodiment of a geosteering, measurement and/or and monitoring system includes a measurement assembly disposed in a first well for estimating the location of a second well during drilling of the second well. The measurement system may also be configured to perform downhole measurements of properties of the first well and/or the formation. The measurement system includes an acoustic sensor. The acoustic sensor may include one or more discrete sensors, or a distributed sensing assembly that includes multiple discreet sensors or a distributed acoustic sensor such as a fiber optic distributed acoustic sensor (DAS).

In one embodiment, the measurement system includes an optical fiber sensor 40 having one or more optical fibers. At least one optical fiber is configured as a DAS fiber that receives an interrogation signal from an interrogation unit 42 (or other signal source) and generates reflected signals that are analyzed to estimate acoustic properties. The system 10 may also include fiber optic components for performing various functions in the system 10, such as communication and sensing various additional parameters. Exemplary additional parameters include temperature, pressure, stress, strain, vibration of downhole components and deformation of downhole components. The optical fiber sensor 40 can be configured as a cable or other elongated member, and may include additional features such as strengthening and/or protective layers or members, and additional conductors such as electrical conductors and additional optical fibers for sensing and/or communication.

The optical fiber or DAS fiber can be disposed in a borehole via any suitable carrier The optical fiber of the optical fiber sensor 40 includes one or more sensing locations disposed along the length of the optical fiber sensor 40. Examples of sensing locations include fiber Bragg gratings (FBG), mirrors, Fabry-Perot cavities and locations of intrinsic scattering. Locations of intrinsic scattering include points in or lengths of the fiber that reflect interrogation signals, such as Rayleigh scattering locations. The optical fiber sensor 40 may be disposed on the production conduit 36, on casing 44 (e.g., cemented with the casing 44), or any other suitable location, either temporarily or permanently.

The interrogation unit 42 is configured to transmit an electromagnetic interrogation signal into the optical fiber sensor 40 and receive a reflected signal from one or more locations in the optical fiber sensor 40. The interrogation unit 42 includes components such as a signal source 46 (e.g., a pulsed light source, LED, laser, etc.) and a signal detector 48. In one embodiment, a processor 50 is in operable communication with the signal source 46 and the detector 48 and is configured to control the source 46 and receive reflected signal data from the detector 48. An example of an interrogation unit is a reflectometer unit that includes, for example, an optical frequency domain reflectometry (OFDR) and/or optical time domain reflectometry (OTDR) type interrogator. The types and configurations of components are not limited to those described herein and shown in FIG. 1. For example, the acoustic sensor(s) described herein may be optical fiber sensors, or an array of discrete sensors (e.g., piezoelectric sensors and/or geophones) arrayed along the borehole 12. Exemplary discrete sensors include multi-axial sensors, such as triaxial sensors, that provide directional acoustic sensing in three orthogonal directions or in a selected number of directions.

In one embodiment, the optical fiber sensor 40 is configured as a distributed acoustic sensor (DAS), which includes at least one DAS optical fiber, such as a single mode fiber, coupled to the interrogation unit 42. Distributed acoustic sensing (DAS) uses pulses of light from a highly coherent electromagnetic source (e.g., laser) to measure vibrations sensed by an optical fiber such as the DAS fiber. Light in the fiber naturally undergoes Rayleigh scattering as it propagates down the fiber and light scattering from different sections of the fiber can interfere with each other. By looking at the time variations in these interference signals, DAS can be used to measure the acoustic vibrations sensed by a fiber as it undergoes time varying strain.

In one embodiment, the measurement system, including an acoustic sensor in a first borehole, is coupled to or is a part of a geosteering system and is configured to estimate the position of a second borehole relative to the first borehole, e.g., during drilling of the second borehole. This system is useful for, e.g., maintaining the second borehole within an area or formation of interest, directing drilling along a selected path, and avoiding collisions of the second borehole with the first borehole. In addition, the measurement system can also be used for monitoring and/or measurement after the second borehole has been drilled. For example, the DAS fiber of the measurement system is cemented into the casing of the first borehole or disposed with a production string in the first borehole for long term temperature and acoustic monitoring of the formation during steam injection and bitumen production. Measurements of the location of a second borehole with respect to a first (reference) borehole may also be made after the second borehole has been drilled, by employing an acoustic signal source deployed in the second borehole via a wireline sonde or coiled tubing assembly. These measurements mat be employed, e.g., as a secondary means of conducting a trajectory survey of the second borehole.

In addition to detecting the location of the second borehole, acoustic signals can be analyzed to estimate characteristics or properties of the surrounding formation. For example, a portion of the length of the DAS fiber (or other sensor array), such as the portion of the sensor 40 that extends horizontally beyond the horizontal location of the drill bit 54, can extend beyond the location of the drill bit and receive acoustic signals that are transmitted ahead of the bit. Such signals received from the sensor locations can be used to estimate formation characteristics ahead of the bit, providing "look-ahead" capability.

For example, as shown in FIG. 2, after the first borehole 12 is drilled, the second borehole 14 is drilled using a drill string 52 coupled to a drilling assembly that includes a drill bit 54. The drilling assembly is controlled by a suitable control processing device, such as a control unit 56. The control unit 56 is configured to receive measurement signals (e.g., pressure or flow rate, rotational rate, weight on bit, etc.) and control drilling parameters, such as rotational rate, axial weight and direction based on the measurement signals. The control unit 56 includes components such as a processor 58 and a memory 60 for receiving data, processing data and/or controlling drilling parameters.

The control unit 56 receives information from the interrogation unit 42 regarding the position of the drill bit 54 or other components in the drill string 52, which is used by the control unit 56 to adjust the direction of drilling if needed. Although the control unit 56 and the interrogation unit 42 are shown as separate devices, they can be incorporated into a single device or measurement/control system.

Figure 3:
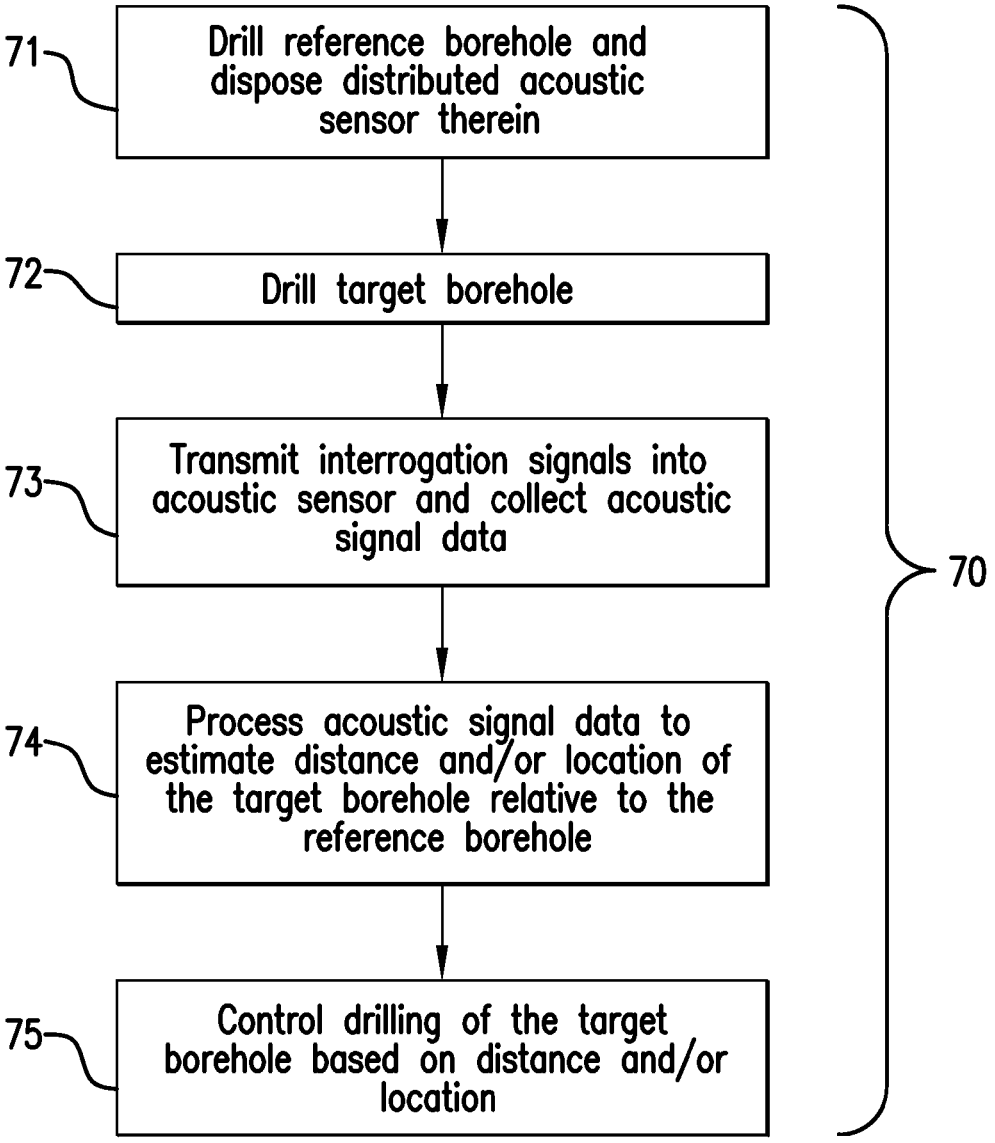
FIG. 3 depicts a flow chart providing an exemplary method of estimating the position of a borehole during drilling.

FIG. 3 illustrates a method 70 of performing a drilling, measurement and/or production operation, monitoring a location of a borehole during drilling, and/or monitoring production of petroleum from an earth formation. The method 70 includes one or more stages 71-75. In one embodiment, the method 70 includes the execution of all of stages 71-75 in the order described. However, certain stages may be omitted, stages may be added, or the order of the stages changed. Although the method 70 is described in conjunction with the measurement, injection and production assemblies described herein, the method 70 may be utilized in conjunction with any energy industry system or operation to facilitate drilling and geosteering.

In the first stage 71, a first borehole (referred to as a reference borehole) is drilled and a distributed acoustic sensor or sensing assembly is disposed in the first borehole. For example, the first borehole 12, e.g., the lower or drain hole of a SAGD pair, is drilled and a DAS optical fiber sensor 40 is disposed in the borehole 12. The optical fiber sensor 40 may be lowered into the borehole 12 along with any suitable component such as the production conduit 36, or a separate tool string (e.g., wired pipe), and/or can be cemented or otherwise disposed with the borehole casing. For example, the completion of borehole 12 is run with an optical fiber for distributed acoustic sensing (DAS) and distributed temperature sensing (DTS).

In the second stage 72, a second borehole (also referred to as a target borehole) is drilled. For example, the second borehole 14, e.g., the upper or steam injection hole of the SAGD pair, is drilled via drill bit 54.

As the drilling assembly operates, it produces acoustic signals due to vibrations and/or contact between the drilling assembly and the formation. For example, as the drill bit rotates and contacts formation material, it produces acoustic signals or vibrations that propagate through the formation. Other components of the drilling assembly may also produce acoustic signals, such as a mud motor. The drill bit and/or other components of the drilling assembly are utilized as an acoustic source.

Although the method is described in conjunction with locating a drill bit or other acoustic source during drilling, it is not so limited. For example, the acoustic source can be generated by an active source or other vibrating component disposed in a borehole via, e.g., a wireline or drill string. In another example, the acoustic source is vibration of components or fluid flow in a production borehole.

In the third stage 73, acoustic signals generated by the drill bit 54 or other components of the drill assembly are monitored by transmitting at least one interrogation signal into the optical fiber sensor 40, e.g., a DAS fiber in the optical fiber sensor 40. In one embodiment, for example as part of an OTDR method, a plurality of coherent interrogation signal pulses are transmitted into the fiber sensor 40. Additional signals, such as DTS signals, can be transmitted into the DAS fiber or into a separate measurement optical fiber.

Signals reflected from sensing locations in the optical fiber are received by a reflectometer unit for each interrogation signal and/or pulse. The reflected signals are sampled to generate DAS signal data.

For example, to maintain the wells at a constant separation (e.g., about 5 meters), the fiber in the reference hole is used to measure acoustic emissions from the drilling assembly for determining the separation distance between the two boreholes. The DAS/DTS fiber is interrogated with a surface interrogator to obtain distributed acoustic data at one or more instances of time or time periods while the target well is being drilled. Data is acquired at multiple locations along the DAS fiber, e.g., every 0.25, 0.5 or 1 meter along the fiber. Data from each location along the fiber is then treated as a separate time series or "trace", $Tr_i$. Each trace is uniquely related to a location along the instrumented borehole.

In the fourth stage 74, the signal data is processed and/or analyzed to estimate the location of a drill bit (e.g., drill bit 54), a mud motor or other component in the target borehole that produces vibrations.

Characteristics of the signal data are analyzed to determine the relative location of a component of the drill string that emits acoustic signals during the drilling. For example, the drill bit 54 generates an acoustic signal due to contact with the formation during drilling, which can be detected in the signal data. Parameters including, the drill bit location, the distance between the drill bit and the acoustic sensor, the range and the direction can be estimated. In one embodiment, distance alone can be estimated, or both distance and direction.

In one embodiment, a distance "h" between the drill bit and a point on the DAS optical fiber is calculated based on the travel time of the acoustic signal from the drill bit to the fiber. The travel time may be converted to a distance using compressional wave (p-wave) velocity.

The p-wave velocity can be determined using any suitable information source or technique. For example, measurement data collected during or after drilling of the first borehole (e.g., wireline or LWD measurement data) or in another borehole in a similar area or formation is used to determine formation properties and wave velocity. In another example, seismic wave velocity analysis is used to determine wave velocity.

In one embodiment, a cross-correlation analysis of distributed acoustic data is utilized to determine the distance and/or location of the drill bit in the target borehole. This embodiment is described with reference to FIGS. 4 and 5, which shows a drilled reference borehole 80 in which a distributed acoustic sensing fiber is disposed. A second borehole, referred to herein as a target borehole 82 is drilled using a drilling assembly including a drill bit 84, during which measurement data is collected. An exemplary reference borehole 80 is a previously drilled drain hole as part of a SAGD system, and an exemplary target borehole 82 is a steam injection hole. This analysis is not limited to a SAGD system, as it can be employed as part of a drilling process for which a previously drilled hole is present.

At a given location of the drill bit, or for a given distance interval over which the drill bit advances, data is collected over a selected time period for each of a plurality of locations along a length of the DAS fiber. The data may be in the form of multiple traces $Tr_i$ for a number n of fiber locations (i=1 to n).

The traces are cross-correlated to find the "moveout" or time difference value of the maximum in the cross correlation (this is equivalent to the determination of normal moveout velocities). A cross-correlation maximum is calculated for each trace.

Figure 4:
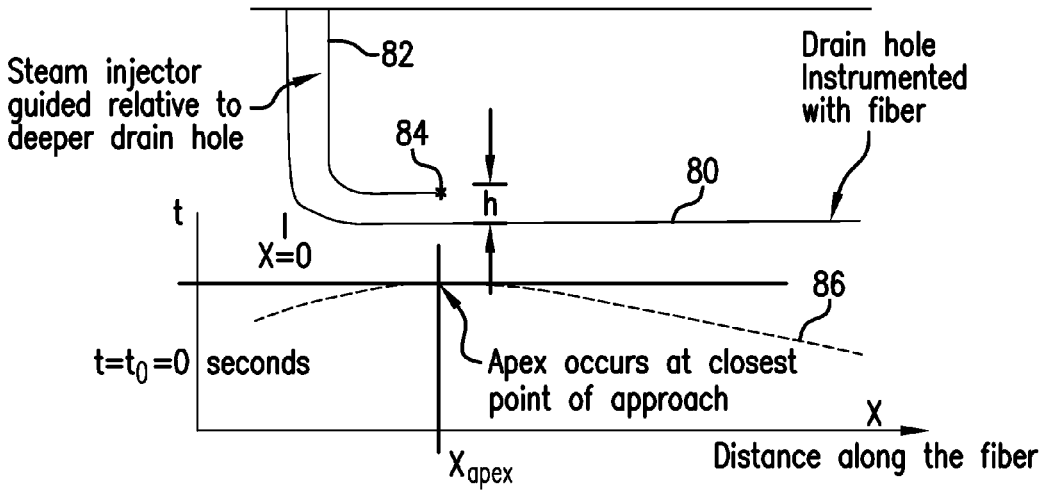
FIG. 4 shows a plot of correlation values for a distributed acoustic sensor in a reference borehole based on acoustic signals received from a drilling assembly in a borehole being drilled.
Figure 5:
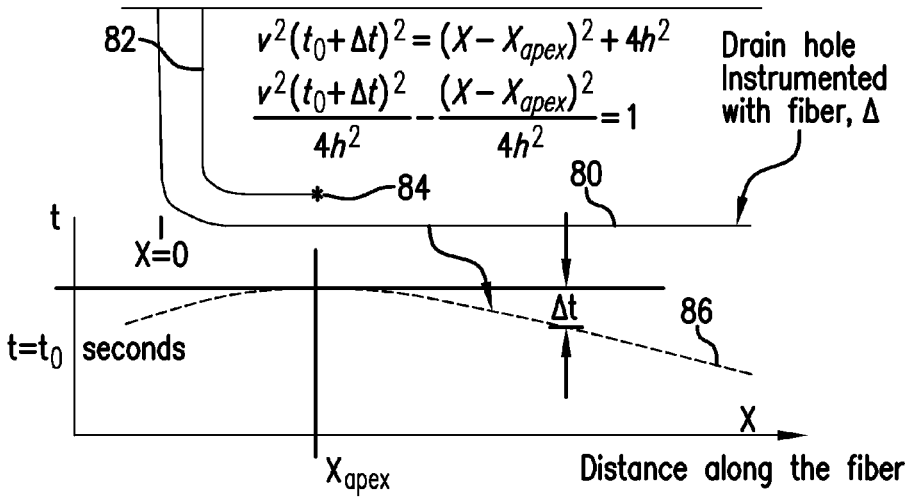
FIG. 5 shows a plot of correlation values for a distributed acoustic sensor in a reference borehole based on acoustic signals received from a drilling assembly in a borehole being drilled.

As shown in FIGS. 4 and 5, a plot 86 of the cross-correlation maximum relative to trace number or trace location (X), defines a hyperbola shape. The apex of the hyperbola ($X_{apex}$) is calculated, and the trace number corresponding to $X_{apex}$ is the location of the DAS fiber that is closest to the acoustic source.

In one embodiment, the shape of the loci X of the of the cross-correlation matrix is fit with the following hyperbolic equation:

$$v^2(t_0+\Delta t)^2=(X-X_{apex})^2+4h^2$$

$$\frac{v^2(t_0+\Delta t)^2}{4h^2}-\frac{(X-X_{apex})^2}{4h^2}=1$$

As discussed above, the p-wave acoustic velocity v can be determined based on various sources of information. Based on the fitting, the unknown time origin of the event ($t_0$), and the current separate distance (h), e.g., the separation of the bit from the closest location of the instrumented reference borehole 80, can be determined.

Using knowledge of v from, e.g., an LWD or wireline log, one unknown of the above equation can be limited. In addition, the distance h can be defined as $h=vt_0$. Based on these considerations, the above non-linear equation can be solved, e.g., using a previous estimate of h ($h(X_{j-1})$) to compute a current estimate of h ($h(X_j)$).

For each time period j selected during drilling, a value of h is calculated, thus providing a distance estimate in real time during the drilling. In one embodiment, the wave velocity is updated for multiple measurement locations along the DAS fiber. However, in one embodiment, the wave velocity is expected to vary slowly and thus the wave velocity need not be updated at every location.

Any suitable method or technique may be used to identify an acoustic signal and/or determine the distance between one or more locations on the DAS fiber and the drill bit based on measuring acoustic signals generated by the drill bit. For example, acoustic signals from the drill bit can be identified by comparing acoustic signatures associated with a specific drill bit or drill bit type, or by comparing acoustic signatures associated with drilling through a specific type of rock or formation material.

The signal data may be analyzed to estimate a direction of the drill bit or other acoustic source in the target borehole. In one embodiment, multiple DAS fibers or other acoustic sources are employed to estimate the direction, e.g., triangulate the source direction. For example, multiple DAS fibers having different radial or azimuthal locations are disposed in the reference borehole (e.g., for a three-dimensional space with orthogonal x, y and z axes, with the z axis being parallel to the borehole axis, the multiple fibers are positioned so that they are differently located in the x-y plane). Multiple fibers could be deployed at or around the outside diameter of the casing to triangulate the acoustic source's direction. In one example, DAS fibers or other acoustic sensors are employed in multiple wells for estimating both direction and distance and the location of the acoustic source.

In one embodiment, the acoustic source direction is estimated using a triaxial or multi axial acoustic sensors or array of acoustic sensors. Such sensors may be used in place of or in conjunction with the DAS fiber to facilitate estimating the direction of an acoustic source.

Various devices and/or methods may be employed to improve the acoustic signal, e.g., by increasing signal amplitudes or by producing more well-defined acoustic signatures. The drill bit may be selected based on the amount of noise produced or whether the bit produces a recognizable signature. For example, a relatively noisy drill bit, such as a hybrid bit, can be used to increase the acoustic signal.

In another example, a second noise or acoustic source is employed to facilitate identification of the acoustic signal from the drill bit or other component in the target borehole. The second acoustic source can be disposed downhole in the target borehole or another borehole, or can be disposed at the surface. In one embodiment, the second acoustic source is an active source that is identifiable, e.g., has a known signature or is activated at known times and/or with a known pattern. The acoustic signal from the drill bit is identified by comparing the data from the DAS fiber or other acoustic sensors to the known signature to isolate the drill bit acoustic signal.

Other improvement techniques include adjusting drill bit operation to produce a noisier or more identifiable acoustic signal. For example, the drill bit can be alternatively slowed or sped up to produce a signal pattern or identifiable change in the acoustic signal. In another example, the drilling process is stopped and the bit is "jarred" by moving the drill string forward and backward to create an impact as the bit impacts the "bottom" of the hole.

Such improvements to the acoustic signal are useful in instances where the acoustic noise from the bit is too narrow band, and the cross-correlation function may not have a well-defined peak. The signal improvements can be used to increase the bandwidth of the noise generated.

In one embodiment, additional measurement devices or systems are included in the reference borehole to facilitate distance measurements. For example, active signal sources (e.g., active acoustic sources) are disposed in the reference borehole. Any suitable carrier may be used to position the active sources, such as a wired pipe. The active sources can be used to transmit a pilot signal and directly measure with correlation the travel time from the bit to each DAS sensor point. In an acoustically isotropic formation, this represents a simple calibration method for displacement vs travel time. One can also generalize the analysis and include velocity anisotropy ($V_{vertical} \neq V_{horizontal}$).

In the fifth stage 75, drilling of the second hole may be adjusted based on the position information. For example, drilling operational parameters can be adjusted based on the distance to maintain the target borehole at a selected minimum distance from the reference borehole, and/or maintain the target borehole parallel to the reference borehole or along any selected path relative to the reference borehole. In addition, acoustic signal measurements may be used in conjunction with other formation evaluation measurements to derive formation parameters.

Although embodiments described herein include a single reference well and target well, they are not so limited. Any number of reference wells can be utilized in estimating location of a target well. For example, acoustic sensing assemblies can be disposed in multiple boreholes, and the acoustic signals from the target well can be detected by the multiple sensing assemblies.

The embodiments described herein provide numerous advantages relative to prior art production systems. In addition, because the sensors described herein detect acoustic signals produced directly by vibrating and/or rotating components in the drilling assembly, no additional acoustic transmitters or other components are needed to generate an acoustic signal. Thus, the sensor assembly can be disposed exclusively with a previously-drilled borehole, thereby reducing system complexity and cost.

For example, typical SAGD steering systems requires running a magnetic or other active source in a first borehole and steering a second borehole to maintain a separation between the boreholes, which is both time consuming and costly, and also requires simultaneous access to both boreholes during drilling to enable the steering method. Embodiments described herein reduce both cost and time consumption relative to such systems.

In support of the teachings herein, various analyses and/or analytical components may be used, including digital and/or analog systems. The system may have components such as a processor, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMs), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

Further, various other components may be included and called upon for providing aspects of the teachings herein. For example, a sample line, sample storage, sample chamber, sample exhaust, pump, piston, power supply (e.g., at least one of a generator, a remote supply and a battery), vacuum supply, pressure supply, refrigeration (i.e., cooling) unit or supply, heating component, motive force (such as a translational force, propulsional force or a rotational force), magnet, electromagnet, sensor, electrode, transmitter, receiver, transceiver, controller, optical unit, electrical unit or electromechanical unit may be included in support of the various aspects discussed herein or in support of other functions beyond this disclosure.

One skilled in the art will recognize that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method of estimating position of a borehole, comprising:

disposing an acoustic sensor in a first borehole in an earth formation, the acoustic sensor including a plurality of measurement locations disposed along a length of the first borehole;

drilling a portion of a second borehole in the earth formation using a drilling assembly;

taking distributed acoustic measurement data over a time period during the drilling by the plurality of measurement locations, the acoustic measurement data based at least in part due to an acoustic signal generated by the drilling assembly and detected by the plurality of measurement locations, the acoustic measurement data including a plurality of traces collected over the time period, each of the plurality of traces associated with a different location along the first borehole;

processing the measurement data to estimate a distance between the drilling assembly and the acoustic sensor, wherein processing includes cross-correlating the plurality of traces and calculating cross-correlation maxima including a cross-correlation maximum associated with each trace, generating a plot of the cross-correlation maxima, and estimating the distance based on an apex of the plot; and controlling directional parameters of the drilling based on the distance.

2. The method of claim 1, wherein the acoustic signal is generated by contact between a drill bit of the drilling assembly and the formation.

3. The method of claim 1, wherein processing the measurement data includes calculating a direction to the second borehole associated with the distance.

4. The method of claim 1, wherein processing the measurement data includes estimating the distance based on a travel time of the acoustic signal between the drilling assembly and the acoustic sensor.

5. The method of claim 4, wherein processing the measurement data includes estimating the distance based on the travel time and a compressional wave velocity associated with the formation.

6. The method of claim 1, wherein each of the plurality of traces associated with one of the plurality of measurement locations.

7. The method of claim 6, wherein processing the measurement data includes performing a fit of the cross-correlation maximum associated with each trace with a hyperbolic function, and calculating a time origin of the acoustic signal based on the fit.

8. The method of claim 7, wherein processing the measurement data includes selecting a trace associated with an apex of the hyperbolic function, and calculating the distance based on the time of receipt of the acoustic signal at the selected trace and a compressional wave velocity associated with the formation.

9. The method of claim 1, wherein the first borehole is one of an injection borehole and a production borehole of a steam assisted gravity drainage (SAGD) system, and the second borehole is another of the injection borehole and the production borehole.

10. A system for estimating a position of a borehole, comprising:

an acoustic sensor disposed in a first borehole in an earth formation, the acoustic sensor including a plurality of measurement locations disposed along a length of the first borehole;

a processor configured to perform:

receiving acoustic measurement data from the plurality of measurement locations over a time period during drilling by a drilling assembly of a portion of a second borehole in the earth formation, the acoustic measurement data based at least in part on an acoustic signal generated by the drilling assembly and detected by the plurality of measurement locations, the acoustic measurement data including a plurality of traces collected over the time period, each of the plurality of traces associated with a different location along the first borehole; and processing the measurement data to estimate a distance between the drilling assembly and the acoustic sensor, wherein processing includes cross-correlating the plurality of traces and calculating cross-correlation maxima including a cross-correlation maximum associated with each trace, generating a plot of the cross-correlation maxima, and estimating the distance based on an apex of the plot.

11. The system of claim 10, wherein the acoustic signal is generated by contact between a drill bit of the drilling assembly and the formation.

12. The system of claim 10, wherein the acoustic sensor includes at least one distributed acoustic sensing (DAS) optical fiber.

13. The system of claim 10, wherein the acoustic sensor includes an array of discrete multi-axial acoustic sensors arrayed along the length of the first borehole.

14. The system of claim 10, wherein processing the measurement data includes estimating the distance based on a travel time of the acoustic signal between the drilling assembly and the acoustic sensor, and a compressional wave velocity associated with the formation.

15. The system of claim 10, wherein each of the plurality of traces associated with one of the plurality of measurement locations.

16. The system of claim 15, wherein processing the measurement data includes performing a fit of the cross-correlation maximum associated with each trace with a hyperbolic function, and calculating a time origin of the acoustic signal based on the fit.

17. The system of claim 16, wherein processing the measurement data includes selecting a trace associated with an apex of the hyperbolic function, and calculating the distance based on the time of receipt of the acoustic signal at the selected trace and a compressional wave velocity associated with the formation.

18. The system of claim 10, wherein the first borehole is one of an injection borehole and a production borehole of a steam assisted gravity drainage (SAGD) system, and the second borehole is another of the injection borehole and the production borehole.

* * * * *